US008859902B2

(12) United States Patent
Matsuda et al.

(10) Patent No.: US 8,859,902 B2
(45) Date of Patent: Oct. 14, 2014

(54) MULTI-CORE CABLE

(75) Inventors: Motoi Matsuda, Kanuma (JP); Katsumi Karube, Kanuma (JP)

(73) Assignee: Sumitomo Electric Industries, Ltd., Osaka (JP)

( * ) Notice: Subject to any disclaimer, the term of this patent is extended or adjusted under 35 U.S.C. 154(b) by 301 days.

(21) Appl. No.: 12/955,651

(22) Filed: Nov. 29, 2010

(65) Prior Publication Data

US 2011/0139485 A1 Jun. 16, 2011

(30) Foreign Application Priority Data

Dec. 10, 2009 (JP) ..... 2009-280460

(51) Int. Cl.

| | |
|---|---|
| ***H01B 7/00*** | (2006.01) |
| ***H01B 11/00*** | (2006.01) |
| ***H01P 3/02*** | (2006.01) |
| *H01B 11/10* | (2006.01) |
| *H01B 13/02* | (2006.01) |

(52) U.S. Cl.

CPC ..... *H01B 11/002* (2013.01); *H01B 11/1025* (2013.01); *H01B 13/02* (2013.01); *H01P 3/02* (2013.01)

USPC ..... 174/113 R; 174/102 R; 174/110 R; 174/109; 174/108

(58) Field of Classification Search

CPC ..... H01B 11/002

USPC ..... 174/109, 108

See application file for complete search history.

(56) References Cited

U.S. PATENT DOCUMENTS

| | | | | |
|---|---|---|---|---|
| 5,216,202 | A * | 6/1993 | Yoshida et al. | 174/36 |
| 6,333,465 | B1 * | 12/2001 | Prudhon | 174/110 R |
| 6,403,887 | B1 * | 6/2002 | Kebabjian et al. | 174/110 R |
| 6,452,107 | B1 * | 9/2002 | Kebabjian | 174/113 R |
| 6,815,611 | B1 * | 11/2004 | Gareis | 174/36 |
| 2004/0050578 | A1 * | 3/2004 | Hudson | 174/113 R |
| 2004/0262027 | A1 * | 12/2004 | Kaczmarski | 174/113 R |
| 2006/0054334 | A1 * | 3/2006 | Vaupotic et al. | 174/36 |
| 2006/0151195 | A1 * | 7/2006 | Donazzi et al. | 174/110 R |

FOREIGN PATENT DOCUMENTS

| | | | |
|---|---|---|---|
| CN | 1367930 | A | 9/2002 |
| CN | 1716463 | A | 1/2006 |
| JP | 08-241632 | A | 9/1996 |
| WO | WO-00-79545 | A1 | 12/2000 |
| WO | WO2006/003746 | A1 | 1/2006 |

OTHER PUBLICATIONS

Chinese Office Action of the corresponding Chinese Application No. 201010588686.2, dated Jul. 25, 2012.

The Chinese First Office Action in corresponding Chinese Application No. 201010588686.2, dated Dec. 23, 2011.

* cited by examiner

*Primary Examiner* — Tuan T Dinh

*Assistant Examiner* — Steven T Sawyer

(74) *Attorney, Agent, or Firm* — Global IP Counselors, LLP

(57) ABSTRACT

A multi-core cable in which skew occurs less and attenuation characteristics of all core cables are uniform comprises: a core unit; an insulation tape spirally wrapped around the outer circumference of the core unit; and a metal coated resin tape wrapped over the insulation tape, wherein a plurality of core cables each consisting of two insulated wires arranged in parallel are stranded together to form the core unit, and wherein the metal coated resin tape is wrapped in the same direction as the stranding direction of the core cables.

3 Claims, 4 Drawing Sheets

MULTI-CORE CABLE

BACKGROUND OF THE INVENTION

1. Field of the Invention

The present invention relates to a multi-core cable in which a plurality of pair cables are shielded altogether with an overall shielding tape.

2. Description of the Background Art

A pair cable consisting of electrically insulated two signal conductors is well known as signal wires for transmitting high-speed digital signals. The method of transmitting signals using a pair cable is called differential signaling. It allows a signal to be output twice on the receiving side, since signals whose phases are reversed by 180 degrees are input into two signal conductors respectively at the same time and transmitted and the difference of the signals are read at the receiving side. Also, such transmission exhibits a noise removal feature because the noise given during signal transmission is equally given to the two signal conductors and hence canceled when it is output as a differential signal at the receiving side. Pair cables are used for wiring in electronic equipment and vehicles in a form of a multi-core cable in which a plurality of pair cables are assembled. (Hereinafter, a pair cable contained in the multi-core cable is called a "core cable".)

Japanese Patent Application Publication No. H8-241632 (Patent document 1) discloses a multi-core cable in which twisted pair cables are adopted as core cables. In this multi-core cable, a plurality of core cables are stranded together to make a core unit and an insulation tape is spirally wrapped in an overlapping manner as an inner sheath layer around the outer circumference thereof, and thereafter a metal foil tape is wrapped as a shielding layer thereover, and further a sheath layer is provided overall by extrusion. Patent document 1 does not mention either a direction in which a plurality of core cables are to be stranded together, nor wrapping direction of the insulation tape or the metal foil tape.

SUMMARY OF THE INVENTION

The object of the present invention is to provide a multi-core cable in which skew occurs less and all core cables are coincident in terms of attenuation characteristics.

To achieve the object, a multi-core cable provided according to an embodiment of the invention comprises: a core unit in which a plurality of core cables each consisting of two insulated wires arranged in parallel are stranded together; an insulation tape spirally wrapped around the outer circumference of the core unit; and a metal coated resin tape wrapped over the insulation tape in the same direction as the stranding direction of the core cables.

The multi-core cable of the present invention is preferably formed such that the ratio of the stranding pitch of the core cables to the wrapping pitch of the metal coated resin tape is 10 to 14. Also, the stranding pitch of the core cables is preferably 50 mm to 700 mm, and the wrapping pitch of the metal coated resin tape is preferably 3 mm to 60 mm.

According to the present invention, it is possible to lessen the occurrence of skew and decrease differences in signal attenuation among a plurality of core cables. Particularly, when transmitting high frequency signals of several to tens of GHz, the difference in signal attenuation among a plurality of core cables can be decreased.

DETAILED DESCRIPTION OF THE INVENTION

Figure 1:
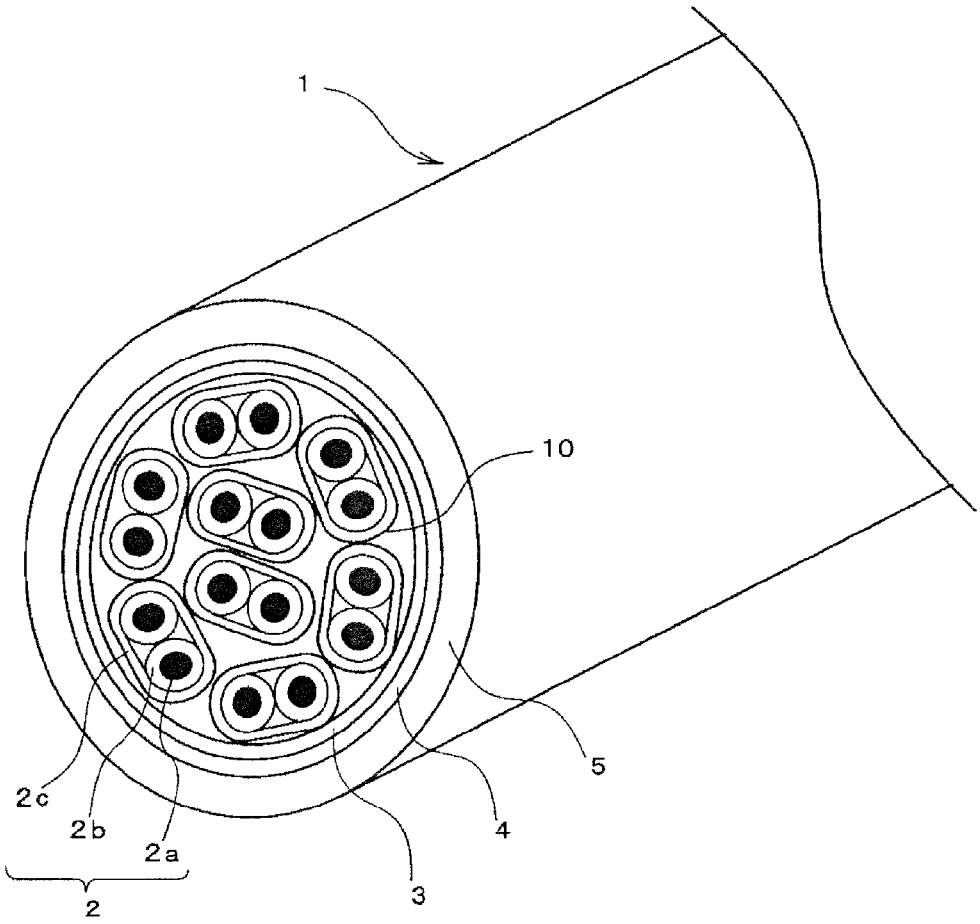
FIG. 1 is a conceptional schematic diagram of a multi-core cable relating to an embodiment of the present invention.

Hereinafter, preferred embodiments of the present invention will be described in reference to the accompanying drawings. The drawings are provided for the purpose of explaining the embodiments and are not intended to limit the scope of the invention. In the drawings, an identical mark represents the same element so that the repetition of explanation may be omitted. The dimensional ratios in the drawings are not always exact.

In the multi-core cable described in Patent document 1, twisted-pair cables are used as core cables and the cross-section of a core unit formed thereof has a nearly circular shape. Therefore, it is possible to wrap a metal foil tape at a comparatively uniform force. However, in the case where two signal conductors arranged in parallel are used as a core cable without twisting so as to decrease the occurrence of skew, the core unit thus formed of core cables will have a circumferential shape which is longitudinally varied. In such case, when an insulation tape and a metal foil tape are wrapped around the core unit, the condition of force applied to the stranded core cables will differ depending on the wrapping direction (winding direction) of these tapes, in particular the wrapping direction of the metal foil tape. If different forces are applied to a plurality of core cables, the strain of the core cables will differ respectively, which will cause differences in variation of the attenuation of transmitted signals. The present invention enables eliminating such differences in the signal attenuation among the core cables even in the case where the outer diameter of the core unit is irregular.

FIG. 1 is a conceptional schematic diagram of a multi-core cable relating to an embodiment of the present invention. A multi-core cable 1 has eight pair-cables. Each of the pair-cables is formed such that two signal conductors 2*a* each of which is covered with an insulator 2*b* are arranged in parallel without being twisted and are altogether spirally wrapped with a resin tape 2*c*. (Hereinafter, each pair cable contained in the multi-core cable is called a core cable. The number of core cables in a multi-core cable according to the present invention is not limited to eight: it is sufficient if even number, for example 2 to 48, of core cables are adopted.)

Each signal conductor 2*a* is an annealed copper wire or a tin-plated annealed copper wire having a size equivalent to AWG 22 to 36 (preferably AWG 24 to 32) that consists of a single wire or stranded wires. The material of the insulator 2*b* is a polyolefin resin or fluororesin such as polyethylene or polypropylene. The cross-sectional size of a core cable 2 is about 4.0 mm by 2.0 mm in the case where a signal wire of AWG22 is used, and about 0.6 mm by 0.3 mm in the case where a signal wire of AWG36 is used. The core cable 2 may be formed by arranging two signal conductors 2*a* in parallel without twisting them and by covering them by means of integral molding. In such case, the core cable can be formed in a cross-sectional shape having longer sides and shorter sides, such as an elongated circular form, an elliptical form, an eyeglasses-like shape, a FIG. 8 shape, or the like.

The eight core cables 2 are stranded to form a core unit 10 altogether. The stranding pitch is approximately 50 mm to 700 mm, and the stranding is performed so as to form a substantially circular shape; however, the shape and sequence are indefinite and unstable.

An electrically insulative overall wrapping tape 3 is spirally wrapped (wound) around the outer circumference of the core unit 10 so as to hold the stranded structure of the core unit. A metal coated resin tape 4 (hereinafter, called "shielding tape") is spirally wrapped (wound) to form a common shielding layer over the overall wrapping tape 3 thus wrapped. A sheath 5 is formed by extrusion over the so-wrapped shielding tape 4 so as to protect the whole thereof.

An insulative paper tape or resin tape can be used as the overall wrapping tape 3, which helps to maintain the shape of the core unit 10 lest it be loosen when the multi-core cable 1 is bent. As for the resin tape, a polyethylene terephthalate (PET) tape can be used, and also a porous fluororesin tape (a POREFLON™ tape, or the like) which has an excellent flexibility can be used. The thickness of the overall wrapping tape 3 that can be used is about 0.01 mm to 0.05 mm, for example.

For the purpose of the shielding tape 4, an aluminum-foil laminated or copper-foil laminated resin film, or aluminum-deposited or copper-deposited resin film can be used. As for the tape thickness, a metal part consisting of aluminum or copper is 0.007 mm to 0.025 mm, and a PET film part is 0.007 mm to 0.025 mm, and the whole thickness is 0.014 mm to 0.05 mm. The shielding tape 4 is spirally wrapped, at an overlapping width of about ⅛ to ⅔ of the tape width and a wrapping pitch of 3 mm to 60 mm, over the overall wrapping tape 3. A shield conductor made by braiding may be provided on the outer circumferential surface of the shielding tape 4 so as to reinforce the shielding layer. As for the conductive material of the braided shield conductor, an annealed copper wire or a tin-plated annealed copper wire can be used as in the case of the core cable. Preferably, the ratio of the stranding pitch of the core cables to the wrapping pitch of the shielding tape is in the range of 10 to 14.

The material of the sheath 5 may be a resin such as polyvinyl chloride (PVC), polyethylene (PE), ethylene-vinyl acetate copolymer (EVA), polyurethane, or the like.

Figure 2:
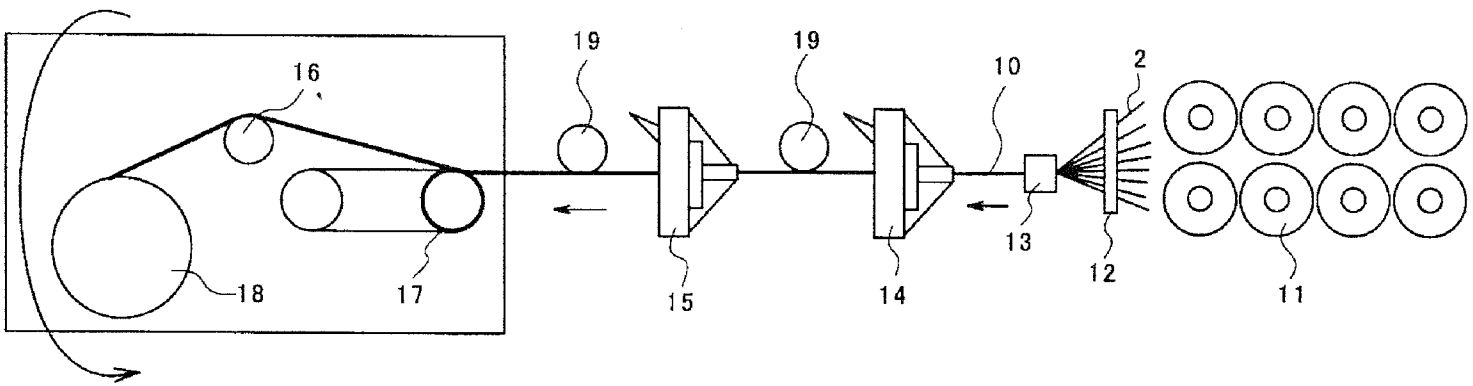
FIG. 2 is a conceptional schematic diagram for explaining the method of manufacturing a multi-core cable of the present invention.

FIG. 2 is a conceptional schematic diagram for explaining the method of manufacturing a multi-core cable of the present invention. A plurality of core cables 2, which are individually supplied from the respective core wire supply reels 11 so as to be fed to the cable manufacturing line, are inserted into through-holes of a collecting plate 12 and assembled to form a core unit 10 by means of a die 13. A capstan 17 and a cable take-up reel 18 turn about the pulling-up direction as the rotating shaft so that a plurality of core cables 2 are stranded together. When the core cables 2 are stranded, the pass line of the core unit 10 is fixed by stranding rollers 19 so that the stranding may not be undone.

An overall wrapping tape is wrapped by a first tape-wrapping machine 14 around the outer circumference of the core unit 10, and subsequently a shielding tape is wrapped by a second tape-wrapping machine 15. Thereafter, the core unit 10 is taken by a capstan 17 and is led by a guide roller 16 so as to be wound on a cable take-up reel 18.

An overall wrapping tape may be wrapped in an arbitrary direction, but a shielding tape is wrapped in the direction in which the core cables are stranded. In the equipment of FIG. 2, by using the second tape-wrapping machine 15, the wrapping direction of a shielding tape is naturally made to be the same as the stranding direction of the core cables by simply applying the shielding tape to the core unit 10 that is wrapped with an overall wrapping tape. In such case, however, the wrapping pitch of the shielding tape and the stranding pitch of the core cables become the same. Therefore, the second tape-wrapping machine 15 is designed to wrap the shielding tape around the core unit that is wrapped with the overall wrapping tape, and then the wrapping pitch is made to differ from the stranding pitch of the core cables. Thereafter, the core unit that is wrapped with the shielding tape is payed out by the cable take-up reel 18 so that it may be provided with a sheath by an extruder.

Figure 3A:
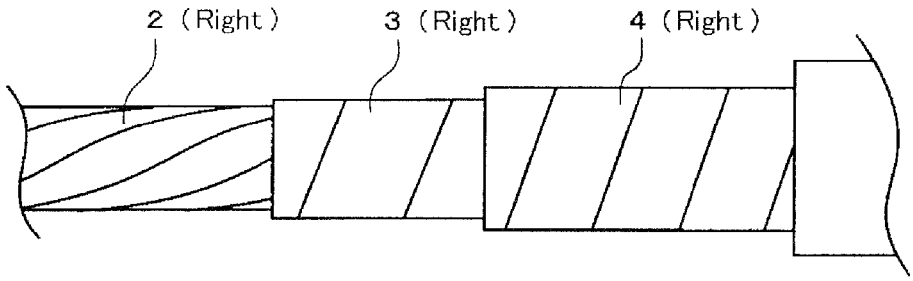
In FIGS. 3A, 3B, and 3C, conceptional schematic diagrams illustrate examples of combination with respect to the stranding direction of core cables, the wrapping direction of an overall wrapping tape, and the wrapping direction of a shielding tape in multi-core cables.
Figure 3B:
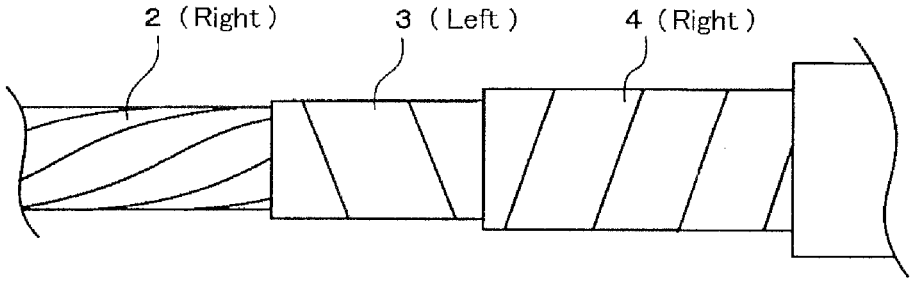
Figure 3C:
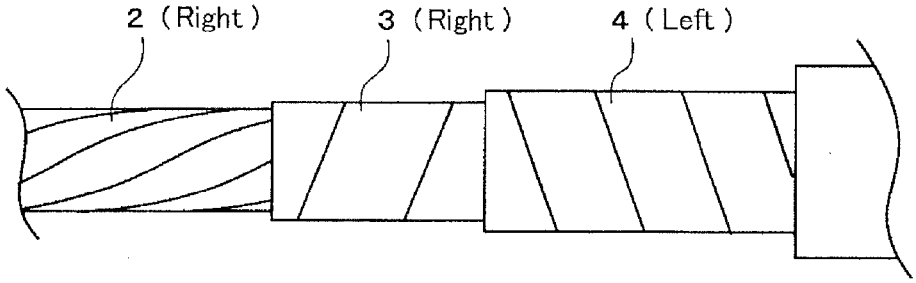

FIGS. 3A to 3C schematically illustrate examples of combination with respect to the stranding direction of core cables, the wrapping direction of an overall wrapping tape, and the wrapping direction of a shielding tape in multi-core cables. FIG. 3A shows an example in which core cables are stranded together in the right direction, an overall wrapping tape is wrapped in the right direction, and a shielding tape is wrapped in the right direction. FIG. 3B shows an example in which the core cables are stranded together in the right direction, the overall wrapping tape is wrapped in the left direction, and the shielding tape is wrapped in the right direction. FIG. 3C shows an example in which the core cables are stranded together in the right direction, the overall wrapping tape is wrapped in the right direction, and the shielding tape is wrapped in the left direction.

Figure 4A:
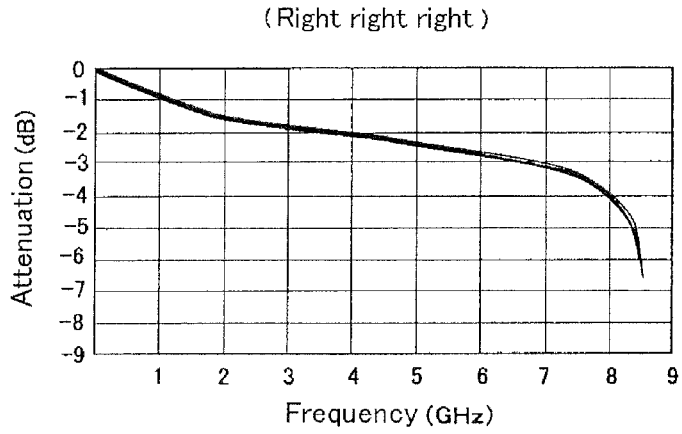
FIGS. 4A, 4B, and 4C include graphs showing relations between transmission signal frequencies and attenuations of transmission signals with respect to the multi-core cables respectively shown in FIGS. 3A, 3B, 3C, respectively.
Figure 4B:
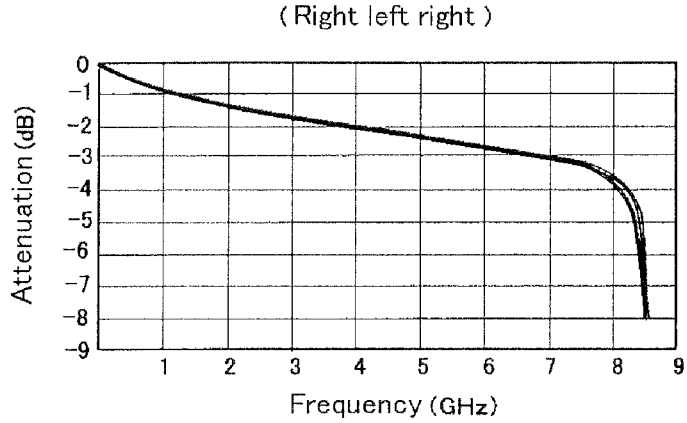
Figure 4C:
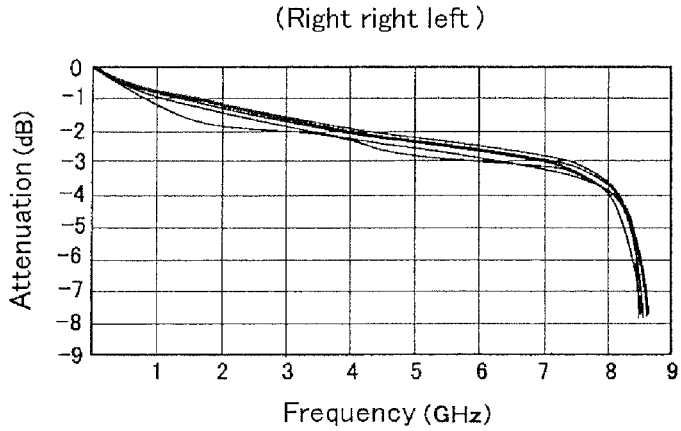

FIGS. 4A, 4B, and 4C include graphs showing relations between the frequency (GHz) of transmission signal and the attenuation (dB) of the transmission signal with respect to the multi-core cables respectively shown in FIGS. 3A, 3B, and 3C respectively. In each of the multi-core cables, core cables are each formed by arranging two insulated wires in parallel without twisting. Each of the insulated wires is formed such that a conductor of AWG26 is covered with polyethylene in a thickness of 0.4 to 0.5 mm. Eight core cables are stranded at a stranding pitch of 250 mm to form a core unit. A shielding tape having a whole thickness of 0.025 mm (the total of the thickness of a metal part and the thickness a PET part) is wrapped over the overall wrapping tape at a wrapping pitch of 22 mm and with a overlapping of ¼ relative to the tape width. The ratio of the stranding pitch to the wrapping pitch is 11.4.

In the case in which the overall wrapping tape and the shielding tape were wrapped in the same direction (right direction) as the stranding direction of the core cables (FIG. 3A and FIG. 4A), the attenuations of the core cables were approximately coincident and satisfactory. Also, in the case in which the overall wrapping tape was wrapped in an opposite direction (left direction) relative to the stranding direction (right direction) of the core cables and the wrapping direction (right direction) of the shielding tape (FIG. 3B and FIG. 4B), the attenuations of the core cables were approximately coincident and there were no problems. In the case in which the shielding tape was wrapped in the opposite direction relative to the stranding direction (right direction) of the core cables and the wrapping direction (right direction) of the overall wrapping tape (FIG. 3C, and FIG. 4C), the attenuations of some of the core cables were varied from each other, resulting in unacceptable products due to differences in attenuation among the core cables.

As a result of the above-mentioned data, it has been proved that if a shielding tape is wrapped in the same direction as a plurality of core cables are stranded together to form a core unit, the transmission characteristics will be excellent for high frequency transmission, substantially no variations existing in the attenuation among the core cables. In addition, when a bending test was performed to confirm braking conditions, it was found that the embodiment mode shown in FIG. 3A was the best, although all examples of FIG. 3 passed the test.

As another example, a core unit was formed by stranding four core cables, which were the same as the previous examples, at a stranding pitch of 300 mm. An overall wrapping tape was wrapped around the core unit, and moreover a shielding tape was wrapped thereon at a wrapping pitch of 24 mm and with an overlapping of ⅓ relative to the tape width. The ratio of the stranding pitch to the wrapping pitch is 12.5. In this example also, the cables in which the shielding tape was wrapped in the same direction as the stranding direction of the core cables like the previous examples had less variations among the core cables in terms of attenuation and exhibited excellent transmission characteristics for a high frequency transmission.

What is claimed is:

1. A multi-core cable consisting of:

a core unit;

an insulation tape spirally wrapped around the outer circumference of the core unit;

a metal coated resin tape wrapped over the insulation tape; and a sheath coating the metal coated resin tape, wherein the core unit includes a plurality of core cables stranded together, each of the plurality of core cables consisting of two insulated wires arranged in parallel with a resin tape wrapping the two insulated wires, each of the insulated wires having its own insulation, the insulation and insulated wire having a circular shape as viewed in cross-section, and wherein the metal coated resin tape is wrapped in the same direction as the stranding direction of the core cables such that the multi-core cable has attenuation of 1 dB at 1 GHz and −4 dB at 8 GHz.

2. The multi-core cable according to claim 1, wherein the ratio of the stranding pitch of the core cables to the wrapping pitch of the metal coated resin tape is 10 to 14.

3. The multi-core cable according to claim 1, wherein the stranding pitch of the core cables is 50 mm to 700 mm, and the wrapping pitch of the metal coated resin tape is 3 mm to 60 mm.

* * * * *